United States Patent [19]

Scheurer et al.

[11] Patent Number: 4,551,107

[45] Date of Patent: Nov. 5, 1985

[54] FLOTATION GARMENT

[76] Inventors: Robert S. Scheurer; Stephen M. Scheurer, both of P.O. Drawer 539, Wichita Falls, Tex. 76307

[21] Appl. No.: 462,844

[22] Filed: Feb. 1, 1983

[51] Int. Cl.[4] ..... B63C 9/10

[52] U.S. Cl. ..... 441/112; 441/113; 441/116

[58] Field of Search ..... 441/88, 106, 108, 111–119

[56] References Cited

U.S. PATENT DOCUMENTS

| | | | |
|---|---|---|---|
| 1,492,041 | 4/1924 | Long | 441/108 |
| 2,363,639 | 11/1944 | Brown | 441/112 |
| 2,563,966 | 8/1951 | Shaw | 9/17 |
| 2,802,222 | 8/1957 | Chapman | 9/17 |
| 3,042,947 | 7/1962 | Bashore | 9/338 |
| 3,049,735 | 8/1962 | Baker | 441/108 |
| 3,137,015 | 6/1964 | Lindeman | 441/113 |
| 3,247,531 | 4/1966 | Baker | 9/338 |
| 3,266,069 | 8/1966 | O'Link | 9/341 |
| 3,300,797 | 1/1967 | Scheurer | 441/112 |
| 3,383,722 | 5/1968 | Le Blanc | 9/338 |
| 3,733,631 | 5/1973 | Cohn | 441/113 |
| 3,883,914 | 5/1975 | Blair | 9/341 |
| 4,038,713 | 8/1977 | O'Link | 441/112 |
| 4,167,051 | 9/1979 | Galecke | 9/329 |
| 4,181,993 | 1/1980 | McDaniel | 9/329 |
| 4,263,686 | 4/1981 | Jarvis | 441/116 |
| 4,281,428 | 8/1981 | Rochlin | 9/342 |

*Primary Examiner*—Trygve M. Blix
*Assistant Examiner*—Stephen P. Avila
*Attorney, Agent, or Firm*—James C. Wray

[57] ABSTRACT

A water ski vest is formed of EVA cross-linked polyethylene. The vest fits around the torso or over the shoulders of the wearer and is held in place by belts which extend around the vest. The belts extend through indented loops formed in the polyethylene material to prevent the belts from contacting the wearer's skin. Loops riveted or sewn onto the male ends of the belts extend through the loops in the vest to transmit stress directly to the belts instead of the foam material. The surfaces of the foam material are provided with a fine mesh texturing to give the material a cloth-like feel and appearance. Creasing patterns formed in the shoulder portions and in the back and side portions provide flexibility. The shoulder material is tapered in thickness to reduce bulk and the upper portion of the back is tapered in thickness to minimize catching water in a hard fall. The outer perimeter edges of the vest are rounded to enhance comfort and appearance.

17 Claims, 12 Drawing Figures

FIG. 1
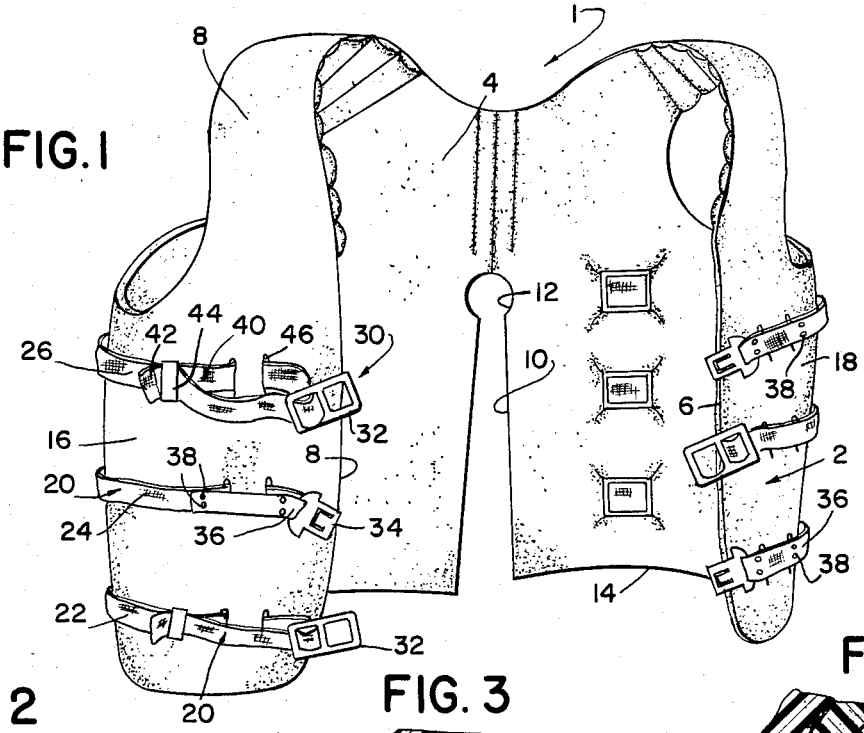
FIG. 2
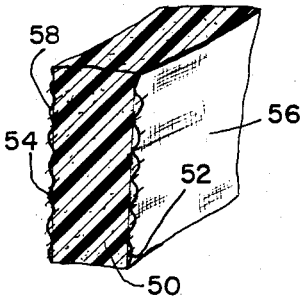
FIG. 3
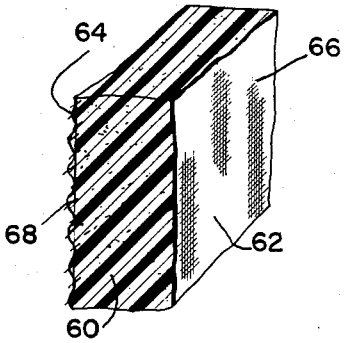
FIG. 4
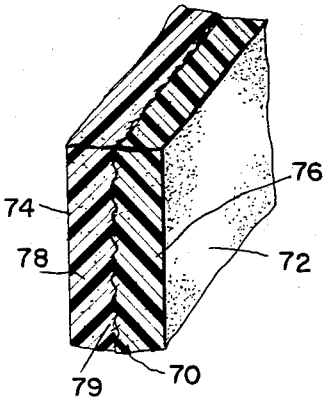
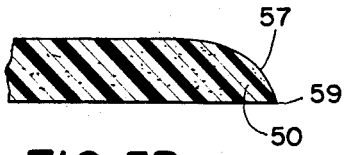
FIG. 5B
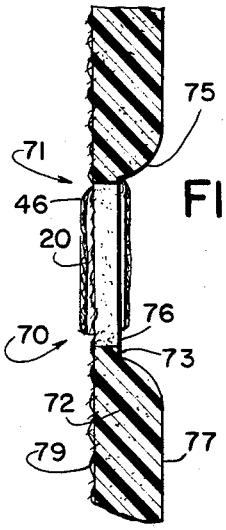
FIG. 6
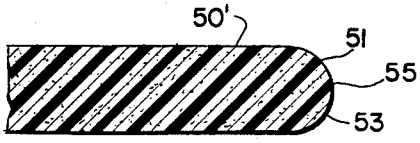
FIG. 5A

FLOTATION GARMENT

BACKGROUND OF THE INVENTION

Flotation garments are well known. Usually, they include vests which are commonly referred to as life jackets, and belts. They may include other devices which have buoyant materials for helping support the body near the water surface with particularly the head of the body or at least the face supported out of the surface so that a person wearing the garment may float on or near the surface with little or no effort.

Garments which are used in sports have several requirements, among which are the flexibility and nonrestrictiveness of the garment so that it does not encumber or provides minimal encumbrance to the activity with which the garment is used.

Of primary importance, is the integrity of the garment and its ability to perform the desired function after long and repeated usage, sometimes in stressful situations.

In garments which are intended for use in sports, the ability to function after high impact is extremely important. That ability must be provided in the context of providing a vest which is as compact and nonrestrictive of movement as possible. The integrity of various parts of the vest under high impact conditions must be provided.

SUMMARY OF THE INVENTION

The present invention meets the objectives of flotation garments intended for sports use and especially sports use in high impact stress conditions.

The device of the present invention is preferably made of a foam material, especially a closed cell foam material. Preferably, the device is made of EVA cross-linked polyethylene which is compression formed in a cold dye after being heated to an acceptable temperature. The main body of the device is cut from a single piece of foam material and shoulder straps may be cut from the same material or from a compressed or thinner material. Alternatively, the device may be constructed in one intricately formed, molded piece. Preferably all edges are rounded inward, forming a half round edge. Cutting the material from a sheet and the forming of the edges may be concurrently accomplished. Vertical creases in sides and the back may be concurrently made. All of the edge forming and creasing and compression forming can be made in cold dyes after the material is heated to an appropriate temperature.

In a preferred form of the invention, belt loops are intricately formed in the vest by cutting vertical slots in the vest while cutting and forming the vest and by compressing rectangular areas between and around the slots outward from the inner surface of the vest so that a dense foam area between and around the belt loop slots is formed. Preferably, the inner surface of the vest is rounded outward toward the slots, forming a quarter round, framed area around the slots.

The compression serves the very important purpose of keeping the webbing of the belt from contacting the wearer's skin when the vest is worn with a bathing suit as in water skiing. The compressed belt loop areas also remove stress that is normally present when the web body strap has to traverse the full thickness of the vest when passing through the die-cut belt-loops. The web body straps thus pass around the entire outside of the vest with minimal diversion of the body strap from the general curvilinear line of the body strap being required to secure the body strap through the belt loop strips.

In the preferred form of the invention, the body straps are continuous outward straps which are threaded through the belt loop slots. The ends of the straps are folded back across the end strap loops and are joined to the strap portions entering and exiting the end belt loop. That ensures that, upon high impact, the tension in the body strap is born fully by the body strap and does not tend to pull radially outward on the belt loop portion of the garment. In an alternative form of the invention the body straps have a continuous outward strap joined to a strap section which threads through the belt loop slots in the garment. In still another form of the invention, short sections of webbing extend across the belt loops and are connected to the main body strap portions threaded through the belt loops. Connections between strap portions can be by rivets or by heavy stitches or by any convenient and strong and reliable manner.

The secondary attaching strap may be used in all or in only some of the belt loop slots. Advantages of the secondary attaching loop are realized when the loop is used with one or more of the belt loop attachments on the garment. Particularly, it is highly desirable to use the secondary connecting strap at the belt loop attachments nearest the buckle and especially nearest the male buckle portion.

This unique approach solves a difficult problem while, at the same time, transmitting most or nearly all of the stress, as in a hard ski fall, to the body strap instead of the softer and more fragile foam itself. The use of the secondary body strap at one portion of the buckle to move as the strap is adjusted. It may be desirable to anchor one end of the strap with a secondary, riveted or sewn loop while allowing the remainder of the strap to slide through belt-loop openings in the garment to provide adjustment. Anchoring one end of the strap with a secondary loop fixes the buckle position with respect to the front opening while allowing the remainder of the strap to slide and adjust the circumference of the garment. Anchoring one end of the strap to the belt helps the strap to remain in position and functional, even under conditions of unexpected impacts which might tend to tear the strap out of the remaining belt loops. That modification is particularly useful where a garment is adjustable in circumferential size, such as in garments having divided or vertically slit sides or backs. In garments having integral sides and backs and in garments having body straps above vertical slits in sides or backs, one or more of the straps and, particularly, the upper strap may be provided with secondary anchoring loops passing through slit belt loops in the garment.

In still another alternative embodiment, the body straps can be connected directly to the body of the garment itself as by riveting, stitching, or by any other means.

In garments with size adjustment provided only by separating and closing the front of the vest, the body straps may be anchored to the slit belt loops with secondary straps, and the strap adjustment may be provided over the front opening.

In the preferred embodiment of the invention, vertical, rounded creases are provided in the inner surface of the garment along sides and back portions to provide flexibility and comfort and to provide folding for compact storage and shipping. The crease in the center of the back and the creases in the center of the sides are important for folding.

In preferred embodiments, rounded creases are formed in the inner surface of the portion overlying the shoulders to provide comfort and flexibility, especially when using the arms in sports. In a preferred embodiment, the shoulder creases radiate inward from narrow spacing adjacent lateral portions of the shoulder straps to relatively wide spacing on inward parts of the shoulder portions and portions overlying the upper chest of the wearer. This unique creasing provides maximum flexibility at the outer shoulder portions and maximum flotation with flexibility at the inner shoulder portions.

In a preferred embodiment, the last four to six inches of the shoulder strap portions on both sides of the places where the shoulder portions join the body portions taper in thickness from full thickness down to about half thickness or less to provide a comfortable and non-bulky crossing of the shoulders.

In an alternative embodiment, shoulder creases are provided only on portions of the shoulder overlying the upper chest of the wearer and the remainder of the shoulder is formed of reduced thicknesses of material to provide flexibility. It is understood, however, that creases could be provided on the reduced thickness shoulder if desired.

In a preferred embodiment of the invention, the upper back portion of the vest is tapered for about the upper three or four inches or more to minimize catching of water by the vest in a hard fall, such as when water skiing. The inward taper of the upper portion of the vest and the inward taper of the shoulder portions provide added flexibility and comfort, as well as minimizing the water catching. Water catching is undesirable because it tends to bring a sliding body to an abrupt, jarring halt, and because it may tend to pull the garment away from the wearer.

In an alternative embodiment, the entire back is formed of reduced thickness material to give the back less buoyancy than the front. This arrangement causes the wearer of the vest to be urged in a face-up floating position in the water.

In a preferred embodiment of the invention, the inner surface of the garment is provided with a fine mesh texturing which makes the foam plastic feel almost like velvet. The foam may be internally or externally reinforced with fibres or with nonwoven or woven fabric.

In one form of the invention, the perimeter edges may be cut and may be rounded as they are cut by using hot or cold dies. In one preferred form, opposite dies may be rounded or dulled. Precisely joining the dies at the center of the thickness of the foam material rounds both inner and outer edges to provide half-rounded edges on the garment.

BRIEF DESCRIPTION OF THE DRAWINGS

FIG. 1 is a perspective view of a preferred view of a preferred buoyant vest embodiment of the invention.

FIGS. 2, 3 and 4 are embodiments showing reinforcing.

FIGS. 5A and 5B show preferred embodiments of edges of the garment.

FIG. 6 is a detail of a belt-loop portion of the flotation garment.

DETAILED DESCRIPTION OF THE DRAWINGS

Figure 7:
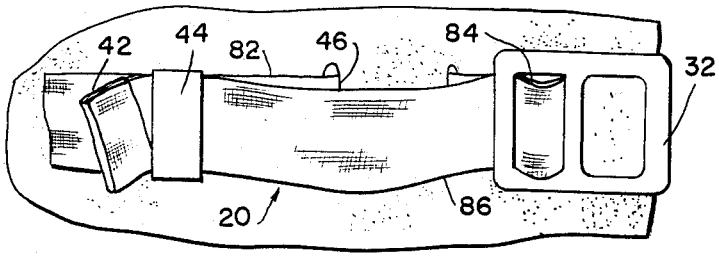
FIG. 7 is a detail of a buckle-mounting and adjustment portion.

Referring to FIG. 1, a buoyant vest flotation garment is generally indicated by the numeral 1. The garment has a front portion 2 and a back portion 4 and a front opening 6. Shoulder portions 8 extend over the shoulder.

A rearward, vertical opening 10 terminates upwardly in a round opening 12 and extends upward from lower edge 14. Sides 16 and 18 are pulled to close to the body by straps 20 which close the front opening 6 and rear opening 10 to adjust the vest to the particular body size and shape of the wearer.

It is understood that the verticle opening 10 could be eliminated to provide the vest with a solid back, if desired.

In a preferred embodiment, the vest has three body straps 20. Lower strap 22, middle strap 24 and upper strap 26 secure the vest on the body of the wearer. It is understood that the number of straps can be varied without departing from the present invention.

Straps 20 have buckles 30 adjacent the front opening 6. Preferably, two female buckle portions 32 are mounted near side 16 and one male buckle portion 34 is mounted on the same side to guard against unintentional opening of the buckles.

In the preferred embodiment end portion 36 of the straps 20 are doubled back across the main straps 20 and are attached to the main straps 20 on opposite sides of belt loops especially near the male buckle portion 34. Rivets 38 connect the end portions 36 to the main straps 20.

In an alternative embodiment, separate auxiliary mounting straps are used in place of the portions 36 and are connected to the main strap 20 in the same manner as the end portion 36. In further alternative embodiment, the auxiliary straps or end portions are threaded through the belt loops and the main straps extend across the outside of the loops.

Strap adjustment means 40 is provided by moving the free ends 42 of the straps through several keepers 44 and/or buckles which permit sliding of untensioned straps but which prevent sliding of tensioned straps. The free ends 42 may be folded double and stitched to prevent their withdrawal from keepers or buckles 44.

To maintain the position of the straps on the garment, parallel slots 46 are provided to form belt loops between the parallel slots. Either the main belts 20 are threaded in and out through the slots or, preferably, auxiliary slack straps 36 are threaded through the slots 46 and are secured to the principal encircling straps, such as by rivets 38.

Principal portions of the garment, such as the belt-loop areas, the shoulder overlying portions 8 and edges, such as at 6, 10, 12 and 14, may be reinforced, or the entire garment may be reinforced. One form of reinforcement is shown in FIG. 2. The polymeric cellular material 50 has secured to the inside 52 and the outside 54 fibers or cloth. In the embodiment shown in FIG. 2, knitted cloth material 56 is connected to the inside surface and similar knitted cloth material 58 is connected to the outside surface. Preferably, stretch cloth material is employed so that the foam material may be bent, and the garment and cloth conform to the desired curvatures and creases throughout the garment. For example, the inner cloth 56 may be stretched into the inner creases and the outer cloth 58 may be stretched to create the desired buoyant vest curvature. One-way or two-way stretch cloth may be employed. Alternatively, the foam may be provided with fibers dispersed in the foam or coated on one or both surfaces of the foam.

FIG. 3 shows an alternate form of the invention in which the reinforcing cloth material 68 is applied only to the outer surface 64 of the cellular material 60. The inner surface 62 has a pattern 66 which may be formed by embedding a grid in a softened surface and removing the grid either before or after the surface hardens. The result is a fine, waffle-like pattern which feels like velvet to the touch.

As shown in FIG. 4, the foam material 70 may be constructed of two layers 76 and 78 which respectively have an inner surface 72 and an outer surface 74. Reinforcement, such as fibers or cloth, may be incorporated at the interface 79.

As shown in FIG. 5A, the foam material 50' has rounded edges formed by cutting heated foam with cold knives or cutting cold foam with heated knives which are dulled or concavely rounded so that the upper knife forms quarter round 51 and the lower knife forms quarter round 53, and the knives meet at center 55 to form half-round edges cutting with a straight blade and compress the form along the edge to alternately form a rounded edge. Alternatively, as shown in FIG. 5B, the cellular material 50 may be formed with edges which are cut by a concave upper blade to form rounded edge 57 which perpendicularly intersects the lower or inner surface at edge 59 to form a quarter-round edge.

Referring to FIG. 6, belt loops 71 are formed by compressing rectangular portions 73 of inner surfaces outward and by cutting parallel vertical slots 46 in the compressed portions 73. Edges 75 around the compressed portions 73 are rounded. When body strap 20 is inserted through openings 46, the portion of the body straps on the inside of the belt loop is displaced outwardly from an inner surface 77 of the foam material so that the strap 20 does not contact the body of a wearer.

As shown in FIG. 6, the area around the belt loop 71 may be reinforced 79 on the outside and/or on the inside to provide additional strength in the belt-loop area.

As shown in FIG. 7, the female buckle portion 32 is secured on the end of a strap 20 by passing the end portion 82 of the strap through belt-loop slots 46 and passing portion 84 through the buckle 32. End portion 86 of the strap is passed through keepers 44 which prevent relative sliding between strap portions 86 and 82 when section 82 is tensioned but which permits sliding between the sections when section 82 is not tensioned, such as when the buckle 32 is unbuckled. The free end 42 of the strap 20 is doubled and stitched to prevent reverse through the keeper 44.

Figure 8:
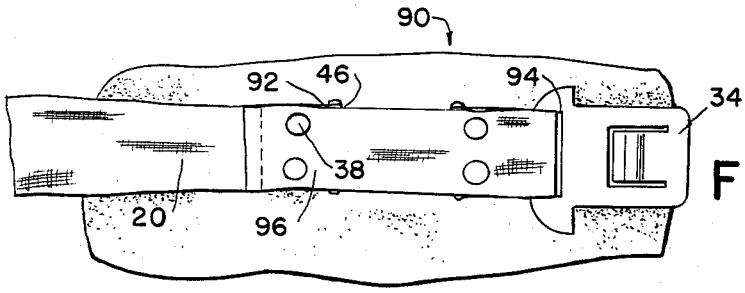
FIG. 8 is a detail of a auxiliary mounting strap threaded through slits in a belt-loop portion of the garment.

As shown in FIG. 8, one preferred form of mounting the mounting straps 20 in the belt loops formed by parallel slits 46 is generally referred to by the numeral 90. Strap 20 has end 92 which passes in and out of slits 46. Portion 94 of the strap is curved around a pin in belt buckle 34. The remainder of the strap 96 is connected to the portion 92 by rivets 38. When the strap 20, shown in FIG. 8, is stressed by pulling on the strap, buckle 34 transmits the force directly to the strap via the end portion 96 and rivets 38.

Figure 9:
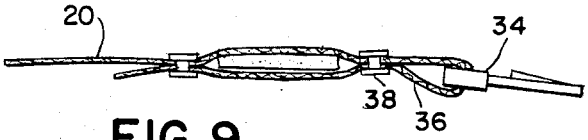
FIG. 9 is a cross-sectional detail of the structure shown in FIG. 8.

Alternately, as shown in FIG. 9, the end of strap 20 may pass directly through buckle 34, and the free end 36 of the strap may be attached by rivets 38 to form a loose loop passing through the belt-loop forming slits 46. Alternatively, auxiliary strap 36 may be formed as a separate strap rather than as the end of strap 20, and strap 20 may be cut off and attached to itself after looping around the buckle 34.

Figure 10:
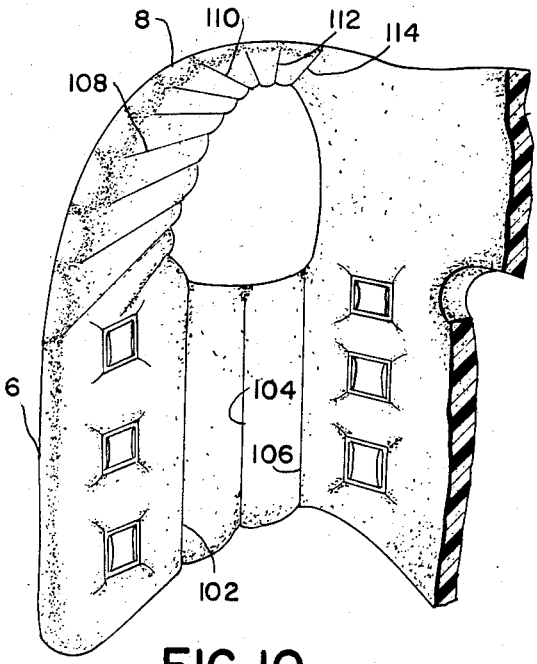
FIG. 10 is a partial, inside view of the buoyant vest shown in FIG. 1.

As shown in FIG. 10, in a preferred embodiment of the vest, plural creases are formed on the inside of the vest. The vest is shown between front edge 6 and rear edge 10. Vertical creases 102, 104 and 106 at the side enable the device to flexibly surround the body and to lie comfortably on the body in use. In addition, the creases, particularly crease 104, permit the device to be folded flat for storage and shipment.

Creases 108–114 in shoulder-covering portion 8 radiate inwardly from narrow spacing near the outer edge of the shoulder portion 8 to wide spacing near the inner edge of the shoulder portion. The creases provide maximum flexibility near the outer edge of the shoulder portion and permit the movement of the shoulder portion with movement of the shoulder of the wearer. The vertical crease above the rear adjustment slot 10 provides ease in folding, storing and shipping the vest.

Figure 11:
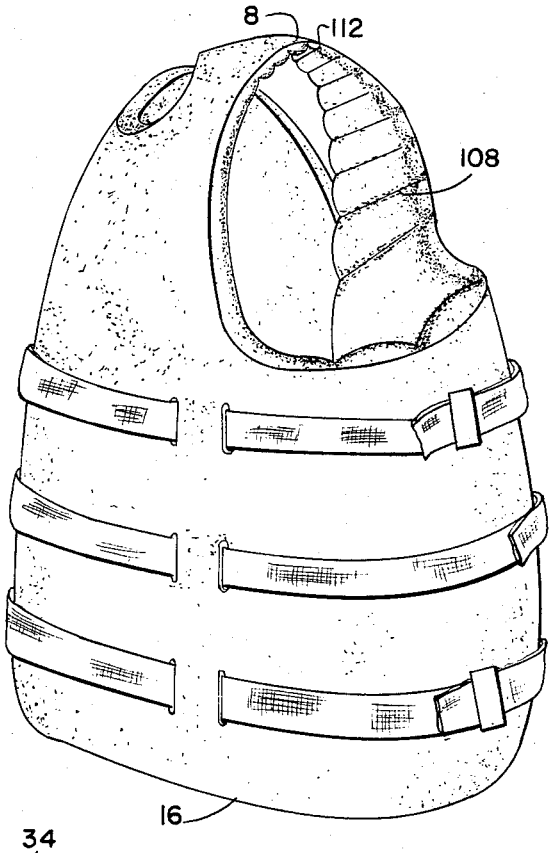
FIG. 11 is a partial, outside view of the vest shown in FIG. 1.

As shown in FIGS. 10 and 11, the shoulder portion 8 tapers to a minimal thickness near the top of a shoulder portion. The back of the vest tapers inward to a minimal thickness adjacent the top of the back of the vest to encourage the back of the vest to lie closely against the body and to avoid catching water, while the vest is worn.

While the flotation device has been described with reference to specific embodiments, it will be obvious that modifications and variations may be constructed without departing from the scope of the invention. The scope of the invention is defined in the following claims.

We claim:

1. A flotation garment comprising a body-encircling portion constructed of polymeric foam material, the foam material being provided with parallel slits, thereby forming belt-loop means between the parallel slits for receiving body-encircling straps surrounding the garment, the flotation garment apparatus further comprising shoulder overlying portions connected to the body-encircling portion and wherein the shoulder overlying portion has rounded creases extending inward into the shoulder portions from surfaces of the shoulder portions, wherein the creases extend across the shoulder of a wearer from outsides of the shoulder overlying portions to insides of the shoulder overlying portions, and wherein the creases are closely spaced adjacent outer portions of the shoulder overlying portions and are widely spaced adjacent inner portions of the shoulder overlying portions.

2. The flotation garment apparatus of claim 1 wherein the belt-loop means are compressed in the foam material between the parallel slits.

3. The flotation garment apparatus of claim 2 wherein the belt-loop means are compressed outwardly from an inner surface of the foam material in the garment, whereby the belt-loop means are spaced outwardly from the body of a wearer.

4. The flotation garment apparatus of claim 3 wherein an area surrounding the parallel slits is compressed outward from an inner surface of the material of the flotation garment.

5. The flotation garment apparatus of claim 1 wherein a portion of the foam material surrounding the slits is reinforced.

6. The flotation garment apparatus of claim 1 further comprising strap means surrounding the garment and wherein the strap means passes inward through a first slit and outward through a second, parallel slit in the foam material of the garment, whereby a strap passes completely around the garment and is anchored to the garment by the belt-loop means in the foam material.

7. The flotation garment apparatus of claim 6 wherein end portions of the strap means are attached to the main portion of the strap means by riveting.

8. The flotation garment apparatus of claim 1 further comprising plural, parallel slits and belt-loop means in the foam material and further comprising plural, body-encircling strap means connected to the belt-loop means for holding the body encircling strap means on the garment and secondary strap means connected to the body-encircling strap means for passing through the belt-loop means on the garment, and wherein at least one of the body-encircling strap means comprises plural, secondary strap means for connecting the body-encircling strap means to the belt-loop means on the garment.

9. The flotation garment of claim 1 further comprising a front opening and means to close the front opening, a vertical crease in the center of the back portion and vertical creases in the center of side portions, the vertical creases having rounded sides and extending inward in the foam material from inner surfaces of the garment.

10. The flotation garment apparatus of claim 1 wherein an upper part of a back overlying portion of the garment is tapered inwardly and reduced in thickness to minimize wave catching of the garment.

11. The flotation garment apparatus of claim 1 further comprising shoulder overlying portions connected to the body-encircling portions and wherein the shoulder overlying portions are inwardly tapered from connections with the body-encircling portions to remote parts of the shoulder overlying portions.

12. The flotation garment apparatus of claim 1 wherein perimeter edges are rounded while being cut to form rounded edges.

13. The flotation garment apparatus of claim 12 wherein the perimeter edges are rounded inward to form quarter-round edges with flat, inward edges of inner surfaces of the foam material.

14. The flotation garment apparatus of claim 12 wherein the outer perimeter edges of the garment are rounded inward from inner and outer sides to form a half-round edge of the garment.

15. The flotation garment apparatus of claim 1 wherein surface portions of the polymeric material are texturized with a fine mesh texturing to provide a velvet-like cloth feel on surface portions of the garment.

16. The flotation garment apparatus of claim 1 wherein at least portions of the foam material are reinforced with cloth material.

17. Flotation garment apparatus comprising a body-encircling portion constructed of a polymeric foam material, the body-encircling portion having side and back portions, at least one vertical crease in the side portion extending from an inner surface outward in the material and terminating short of an outer surface, lateral edges of the crease being rounded, and at least one vertical crease in the central area of the back portion, the vertical crease extending from an upper edge of a back protion of the vest downward to an opening which comunicates with a lower edge of the vest, the back crease having rounded surfaces whereby the back and side crease provide close-lying ability of the vest when worn and provide folding of the vest when shipped and stored, the flotation garment apparatus further comprising shoulder overlying portions and further comprising creases in the shoulder overlying portions radiating from the close spacings near outer edges of the shoulder overlying portions to wide spacing at inner edges of the shoulder overlying portion for permitting and following body movements.

* * * * *